United States Patent [19]

Brunelli et al.

[11] Patent Number: 4,595,412

[45] Date of Patent: Jun. 17, 1986

[54] PRODUCTION OF MOLYBDENUM METAL

[75] Inventors: Timothy A. Brunelli, Towanda; Keith E. Landmesser, Ulster, both of Pa.

[73] Assignee: GTE Products Corporation, Stamford, Conn.

[21] Appl. No.: 757,393

[22] Filed: Jul. 22, 1985

[51] Int. Cl.[4] ..... B22F 9/00

[52] U.S. Cl. ..... 75/0.5 BB

[58] Field of Search ..... 75/0.5 BB, 84, 0.5 AB

[56] References Cited

U.S. PATENT DOCUMENTS 3,407,057 10/1968 Timmons ..... 75/0.5 BB 3,510,291 5/1970 Brush ..... 75/0.5 AB

FOREIGN PATENT DOCUMENTS 74082 6/1970 German Democratic Rep. ... 75/0.5 BB

*Primary Examiner*—Wayland Stallard

*Attorney, Agent, or Firm*—Donald R. Castle; L. Rita Quatrini

[57] ABSTRACT

A process is disclosed for producing molybdenum metal from an ammonium molybdate salt. The process involves heating the salt in a reducing atmosphere at a temperature of no greater than about 775° C. for a sufficient time to convert the major portion of the salt to molybdenum dioxide, and heating the molybdenum dioxide in a reducing atmosphere at a temperature of no greater than about 1095° C. to convert the major portion of the molybdenum dioxide to molybdenum metal.

6 Claims, No Drawings

PRODUCTION OF MOLYBDENUM METAL

BACKGROUND OF THE INVENTION

This invention relates to a process for production of molybdenum metal from an ammonium molybdate salt. More particularly, it relates to a process for producing molybdenum metal of fine particle size.

In the production of molybdenum powder it is desirable to produce fine particle size powder. Fine powder has the advantage of being densified at a faster rate than relatively larger particle size powder, and can be densified to higher densities than the larger size powder at equivalent sintering conditions. Furthermore, fine particle size material reacts more effectively in chemical and catalytic processes than larger particle size material.

REFERENCES

1. K. H. Carpenter and C. J. Hallida, "Comparison of the Reduction of Molybdenum Trioxide by Hydrogen and Ammonia," Proceedings of the Third International Conference on the Chemistry and Uses of Molybdenum, August 1979.

2. S. M. Tuominen and K. H. Carpenter, "Powder Metallurgy Molybdenum: Influence of Powder Reduction Processes On Properties," Journal of Metals, 32 (January 1980) 23–26.

3. S. M. Tuominen, "Preparation and Sintering of Fine Molybdenum Powder," Powder Technology, 30 (1981) 73–76.

SUMMARY OF THE INVENTION

In accordance with one aspect of this invention, there is provided a process for producing molybdenum metal from an ammonium molybdate salt. The process involves heating the salt in a reducing atmosphere at a temperature of no greater than about 775° C. for a sufficient time to convert the major portion of the salt to molybdenum dioxide, and heating the molybdenum dioxide in a reducing atmosphere at a temperature of no greater than about 1095° C. to convert the major portion of the molybdenum dioxide to molybdenum metal.

DETAILED DESCRIPTION OF THE INVENTION

For a better understanding of the present invention, together with other and further objects, advantages, and capabilities thereof, reference is made to the following disclosure and appended claims in connection with the above description of some of the aspects of the invention.

The starting material of this invention can be any ammonium molybdate salt such as ammonium dimolybdate or ammonium paramolybdate.

Typically the ammonium molybdate salt is produced by processing of molybdenum trioxide which is relatively impure. The molybdenum trioxide is subjected to purification processes and the ammonium molybdate salt is crystallized from solution. U.S. Pat. No. 4,525,331 describes a preferred process for producing ammonium molybdate from relatively impure molybdenum trioxide. That patent is hereby incorporated by reference.

Prior to this invention, the ammonium molybdate salt was first converted to molybdenum trioxide by heating at a temperature below the sublimation temperature of molybdenum trioxide. The molybdenum trioxide was then converted to molybdenum dioxide which was then reduced to the molybdenum metal powder. The resulting powder is generally coarse in nature.

According to this invention, the ammonium molybdate salt is heated in a reducing atmpsphere at a temperature of no greater than about 775° C., and preferably from about 540° C. to about 775° C. for a sufficient time to convert the major portion of the molybdate salt to molybdenum dioxide. The required heating time depends on the temperature, the size of the charge, and the size of the furnace. The preferred reducing atmosphere is about 75 mole percent hydrogen and about 25 mole percent nitrogen, or for all practical purposes, dissociated ammonia. Prior to this invention, the reduction of molybdenum trioxide to molybdenum dioxide has been carried out in a stationary tube furnace with the molybdenum trioxide in inconel or molybdenum boats. The preferred method of reducing the ammonium molybdate salt to molybdenum dioxide is by means of a rotary tube furnace or calciner.

The resulting molybdenum dioxider is then heated in a reducing atmosphere at no greater than about 1095° C. and preferably from about 845° C. to about 1000° C. to convert the major portion of the molybdenum dioxide to the molybdenum metal powder. The required heating time depends on the temperature, the size of the charge, and the size of the furnace. The preferred reducing atmosphere is hydrogen.

In actual practice the molybdenum dioxide is first heated preferably at the higher temperature of up to about 1095° C. to promote fine grain production. The temperature is then reduced to preferably about 1060° C. to inhibit grain growth.

The reduction of molybdenum trioxide to molybdenum metal has been done previously in tube type furnaces with the material in inconel or molybdenum boats. The preferred method of carrying out this step of the invention is by means of a flat bottom muffle furnace. This type of furnace has a wider cross sectional area than the tube type furnace, and thereofre provides more contact with the reducing atmosphere, and better heat transfer, and therefore the reduction can be done at lower temperatures than with a tube type furnace, in which reduction temperatures are up to about 1180° C.

In a muffle furnace, the material is in a vessel the entire bottom of which is in contact with the furnace, thus providing better heat transfer than in the prior method of having the material in boats in a tube furnace in which there is less surface contact of the boat with the tube furnace. Due to the improved heat transfer afforded by the muffle furnace, reduction is done at lower temperatures which result in fine particle size molybdenum.

The average particle size of the molybdenum powder of this invention is typically from about 1 micron to about 4 microns.

The combination of direct reduction of the ammonium molybdate salt to molybdenum dioxide, higher surface contact of the reducing atmosphere with the material in both reduction steps, the lower temperature and longer residence time afforded by the larger cross sectional area of the furnace in the reduction of molybdenum dioxide to the metal all contribute to the desired particle size of the molybdenum powder.

Elimination of the conversion step of ammonium molybdate to molybdenum trioxide prior to reduction to molybdenum dioxide and the metal in the processing of relatively impure molybdenum trioxide is desirable from an economic standpoint.

To more fully illustrate this invention, the following non-limiting example is presented.

EXAMPLE

About 77 kilograms of ammonium dimolybdate per hour are heated in a calciner of about 18" in diameter in an atmosphere of dissociated ammonia at about 700° C. with an approximate residence time of 45 minutes. About 58 kilograms of molybdenum dioxide per hour are produced. About 4 kilograms of the molybdenum dioxide are then heated in a gas fired muffle furnace the bottom of which is about 7" wide in a hydrogen atmosphere at about 950° C. with a residence time of about 8 hours and 40 minutes. The molybdenum metal powder produced has an average particle size of about 3 microns.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing molybdenum metal from an ammonium molybdate salt comprising:

(a) heating said salt in a reducing atmosphere at a temperature of no greater than about 775° C. for a sufficient time to convert the major portion of said salt to molybdenum dioxide; and (b) heating said molybdenum dioxide in a reducing atmosphere at a temperature of no greater than about 1095° C. to convert the major portion of said molybdenum dioxide to molybdenum metal.

2. A process according to claim 1 wherein said salt is reduced to molybdenum dioxide in an atmosphere which consists essentially of about 75 mole percent hydrogen and about 25 mole percent nitrogen.

3. A process according to claim 1 wherein said molybdenum dioxide is reduced to molybdenum metal in a hydrogen atmosphere.

4. A process according to claim 1 wherein said salt is heated at a temperature of from about 540° C. to about 775° C.

5. A process according to claim 1 wherein said molybdenum dioxide is heated at a temperature of from about 845° C. to about 1000° C.

6. A process according to claim 1 wherein the average particle size of the molybdenum metal is from about 1 micron to about 4 microns.

* * * * *